US007384286B2

(12) United States Patent
Imai et al.

(10) Patent No.: US 7,384,286 B2
(45) Date of Patent: Jun. 10, 2008

(54) CONNECTOR, CONNECTOR ASSEMBLY AND ASSEMBLING METHOD

(75) Inventors: Yuujirou Imai, Yokkaichi (JP); Tetsuya Shinozaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/713,191

(22) Filed: Mar. 2, 2007

(65) Prior Publication Data

US 2007/0207647 A1 Sep. 6, 2007

(30) Foreign Application Priority Data

Mar. 3, 2006 (JP) ..... 2006-058406

(51) Int. Cl.
*H01R 13/62* (2006.01)

(52) U.S. Cl. ..... 439/157; 439/372

(58) Field of Classification Search ..... 439/372, 439/157

See application file for complete search history.

(56) References Cited

U.S. PATENT DOCUMENTS

| | | | | |
|---|---|---|---|---|
| 5,035,634 | A | 7/1991 | Hasircoglu et al. | |
| 5,230,635 | A | 7/1993 | Takenouchi et al. | |
| 5,263,871 | A | 11/1993 | Sano | |
| 5,391,086 | A * | 2/1995 | Woller et al. | 439/157 |
| 5,427,539 | A * | 6/1995 | Saito | 439/157 |
| 5,855,486 | A | 1/1999 | Fukamachi et al. | |
| 6,254,408 | B1 * | 7/2001 | Hattori et al. | 439/157 |
| 6,264,485 | B1 * | 7/2001 | Saka et al. | 439/157 |
| 6,341,968 | B1 * | 1/2002 | Grant | 439/157 |
| 6,382,992 | B1 * | 5/2002 | Bouchan et al. | 439/157 |
| 6,461,177 | B1 * | 10/2002 | Saka et al. | 439/157 |
| 6,544,054 | B2 * | 4/2003 | Ishikawa et al. | 439/157 |
| 6,905,355 | B2 * | 6/2005 | Fukamachi | 439/157 |
| 6,942,504 | B2 * | 9/2005 | Shinozaki et al. | 439/157 |
| 7,104,831 | B2 | 9/2006 | Fukatsu et al. | |
| 7,201,591 | B2 * | 4/2007 | Fujii | 439/157 |
| 2001/0044228 | A1 * | 11/2001 | Noro et al. | 439/157 |
| 2002/0031927 | A1 * | 3/2002 | Fukamachi et al. | 439/157 |
| 2003/0219306 | A1 | 11/2003 | Tanaka | |
| 2004/0209503 | A1 | 10/2004 | Fukamachi | |
| 2006/0084304 | A1 * | 4/2006 | Ohara | 439/157 |
| 2006/0240693 | A1 * | 10/2006 | Nishide | 439/157 |
| 2006/0286834 | A1 * | 12/2006 | Fukatsu et al. | 439/157 |

(Continued)

FOREIGN PATENT DOCUMENTS

| | | |
|---|---|---|
| JP | 2004-014142 | 1/2004 |

(Continued)

*Primary Examiner*—Ross N Gushi
(74) *Attorney, Agent, or Firm*—Gerald E. Hespos; Anthony J. Casella

(57) ABSTRACT

A connector has female and male housings (10, 60). A cam pin (63) projects from the male housing (60), and a jaw (65) bulges out at the end of the cam pin (63). A lever (30) is mounted to the female housing (10), and has a cam groove (33) for engaging the cam pin (63). A step (38, 39) in the cam groove (33) defines an accommodating portion (42) for the jaw (65). The depth of the accommodation portion (42) is larger near the entrance of the cam groove (33) so that the jaw (65) initially is accommodated loosely. However the depth of the accommodating portion (42) is smaller towards the back of the cam groove (33) to prevent loose movements.

16 Claims, 9 Drawing Sheets

U.S. PATENT DOCUMENTS

2006/0292907 A1* 12/2006 Nishide ..... 439/157
2007/0026709 A1* 2/2007 Fukatsu ..... 439/157
2007/0128902 A1* 6/2007 Matsumura et al. ..... 439/157
2007/0202722 A1* 8/2007 Sasaki et al. ..... 439/157
2007/0207646 A1* 9/2007 Tsuji ..... 439/157

FOREIGN PATENT DOCUMENTS

JP 2006-024435 1/2006

* cited by examiner

CONNECTOR, CONNECTOR ASSEMBLY AND ASSEMBLING METHOD

BACKGROUND OF THE INVENTION

1. Field of the Invention

The invention relates to a lever-type connector, to a connector assembly and to an assembling method therefor.

2. Description of the Related Art

Japanese Unexamined Patent Publication No. 2004-14142 discloses a lever-type connector with first and second housings that are connectable with each other. A lever formed with a cam groove is mounted in first housing and the second housing includes a cam pin. A jaw bulges radially out at the leading end of the cam pin and engages a step at an intermediate position of the cam groove. The step extends substantially horizontally at the same depth along the cam groove, and a space above the step accommodates the jaw. The cam pin enters the cam groove when the two housings are fit lightly together. The lever then is rotated so that the cam pin moves towards the back of the cam groove to urge the housings to a properly connected state. The jaw slides on the step so that the lever does not come out of the first housing during the connecting operation.

A clearance is formed between the step of the cam groove and the jaw due to a dimensional tolerance or the like. If this clearance is too small, it may be difficult for the jaw to move above the step. Thus, a contact pressure of the step of the cam groove and the jaw becomes too high, which might result in difficulty in starting the lever rotation. On the other hand, if this clearance is too large, the central axis of the cam pin may incline with respect to a vertical axis upon the receipt of connection resistance of the two housings while the cam pin is moving in the cam groove. In short, there is no problem if the clearance is set suitably, but it is difficult to constantly define a specified clearance for each product in view of variation in production.

The invention was developed in view of the above situation, and an object thereof is to improve the operability of a movable member for connecting or assisting the connection of a connector with a mating connector.

SUMMARY OF THE INVENTION

The invention relates to a connector with a housing connectable with a mating housing. A movable member having at least one cam groove is mounted movably to the housing and is engageable with at least one cam pin projecting in the mating housing. A stepped or recessed surface is engageable with a jaw of the cam pin and is formed at an intermediate position of the cam groove with respect to a depth direction. The depth of the step of the cam groove in the operable member is larger at the entrance side of the cam groove so that the jaw can be accommodated loosely into an accommodating portion of the cam groove. However, the depth decreases towards the back side of the cam groove so that the jaw can be accommodated in the accommodating portion while having loose movements prevented. Accordingly, the operation of the movable member for connecting the housing with a mating housing is improved.

The depth of the step preferably decreases gradually from the entrance side toward the back side of the cam groove.

The accommodating portion for the jaw preferably is defined in a wider part of the inner space of the cam groove starting from the step.

The inclined section of the step preferably has a depth that gradually decreases from the entrance side toward the back side of the cam groove. However, a section of the cam groove near the back side may have a uniform depth. The jaw preferably can move from the inclined section to the section of uniform depth before the connection resistance of the two housings resulting from the operation of the operable member reaches a maximum value.

The operable member preferably is a single plate.

The operable member preferably is a rotatable lever and an operable portion thereof is near an end distanced from the axis of rotation.

The invention also relates to a connector assembly comprising the above-described connector and a mating connector.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
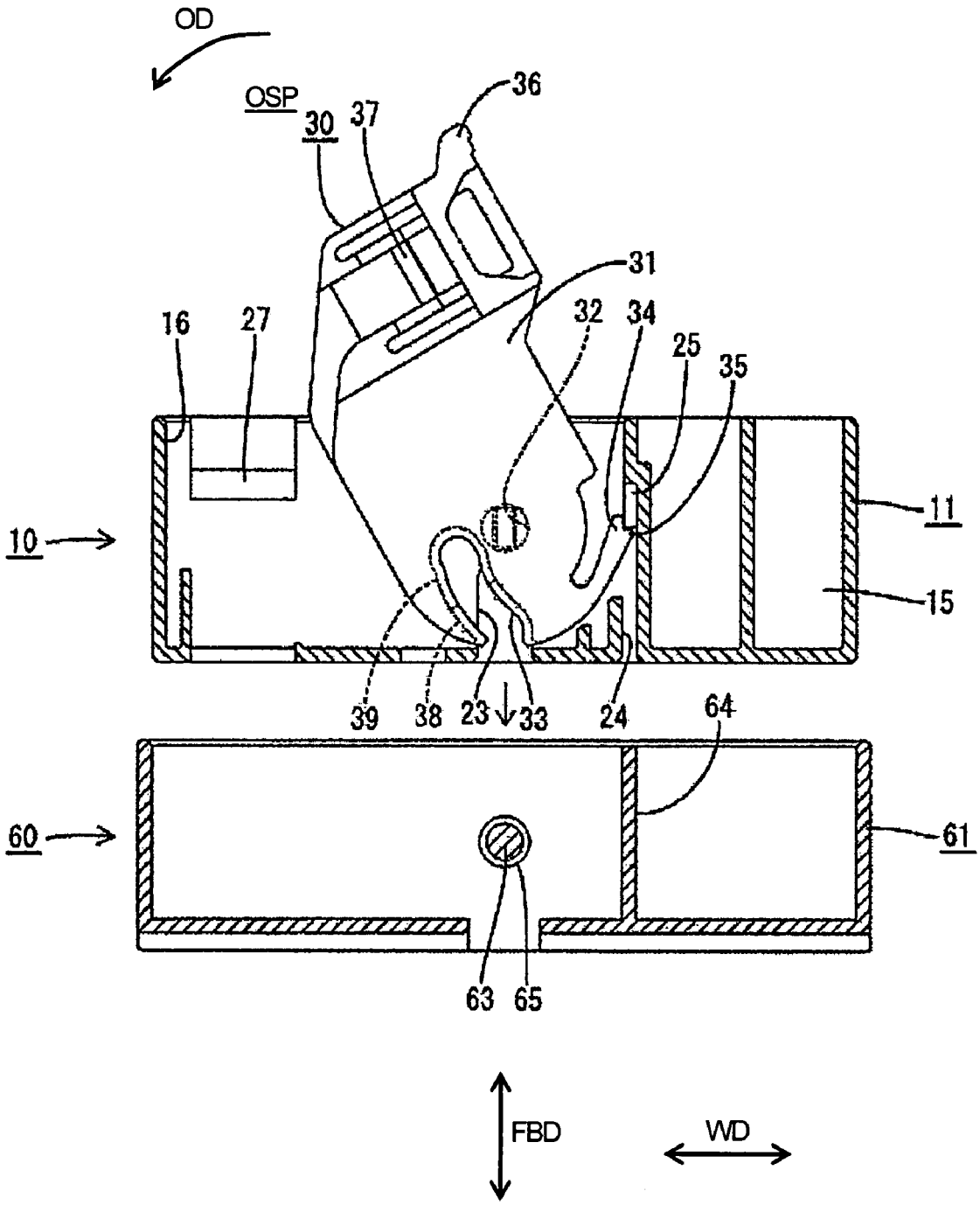
FIG. 1 is a horizontal section of a connector of the invention before male and female housings are connected.

A connector assembly according to the invention is illustrated in FIGS. 1 to 9. The connector assembly has female and male housings 10, 60 that connectable with and separable from each other as shown in FIG. 1. In the following description, ends of the two housings 10, 60 to be connected are referred to as the fronts concerning forward and backward directions FBD and reference is made to FIG. 4 concerning vertical direction.

The female housing 10 includes a holder 11 in the form of a wide rectangular frame capable of accommodating auxiliary housings (not shown). A lever 30 is assembled into the holder 11.

Figure 7:
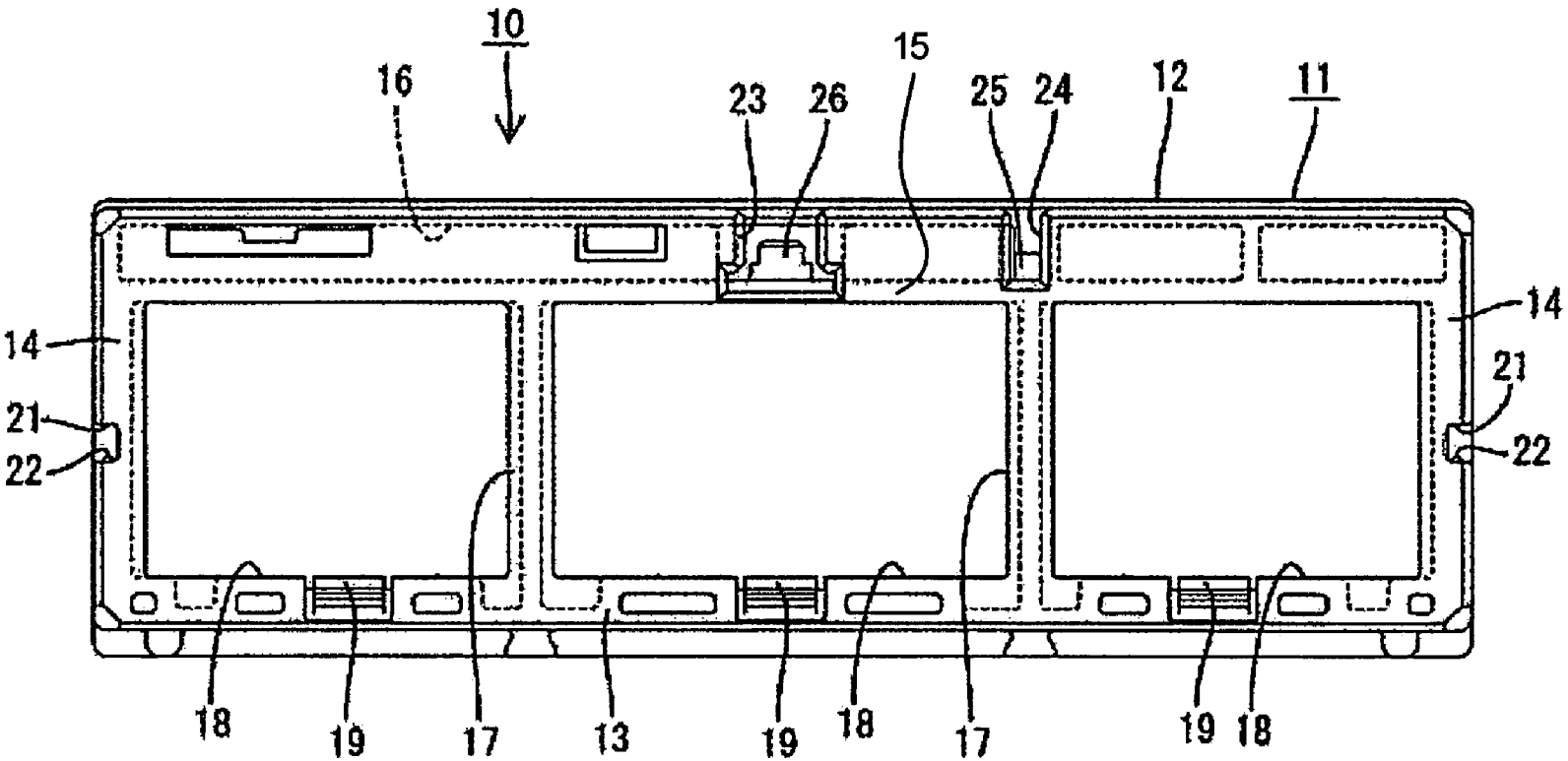
FIG. 7 is a front view of a holder of the female housing.

The holder 11 is made e.g. of synthetic resin and has an upper wall 12, a bottom wall 13 and left and right side walls 14, as shown in FIG. 7. A ceiling wall 15 is disposed below the upper wall 12, and a wide lever accommodating portion 16 is defined between the ceiling wall 15 and the upper wall 12 for accommodating the lever 30. Two partition plates 17 extend between the ceiling wall 15 and the bottom wall 13 and are spaced apart in a width direction in an area of the holder 11 more inward from the lever accommodating portion 16 to form three transversely arranged housing accommodating chambers 18. The auxiliary housings can be fit into the housing accommodating chambers 18 from behind, and resiliently deformable locks 19 are provided at the bottom wall 13 of the respective housing accommodating chambers 18 for retaining the auxiliary housings in the respective housing accommodating chambers 18. The auxiliary housings are not shown to simplify the drawings. However, each auxiliary housing is block-shaped and includes cavities for receiving female terminal fittings.

Figure 8:
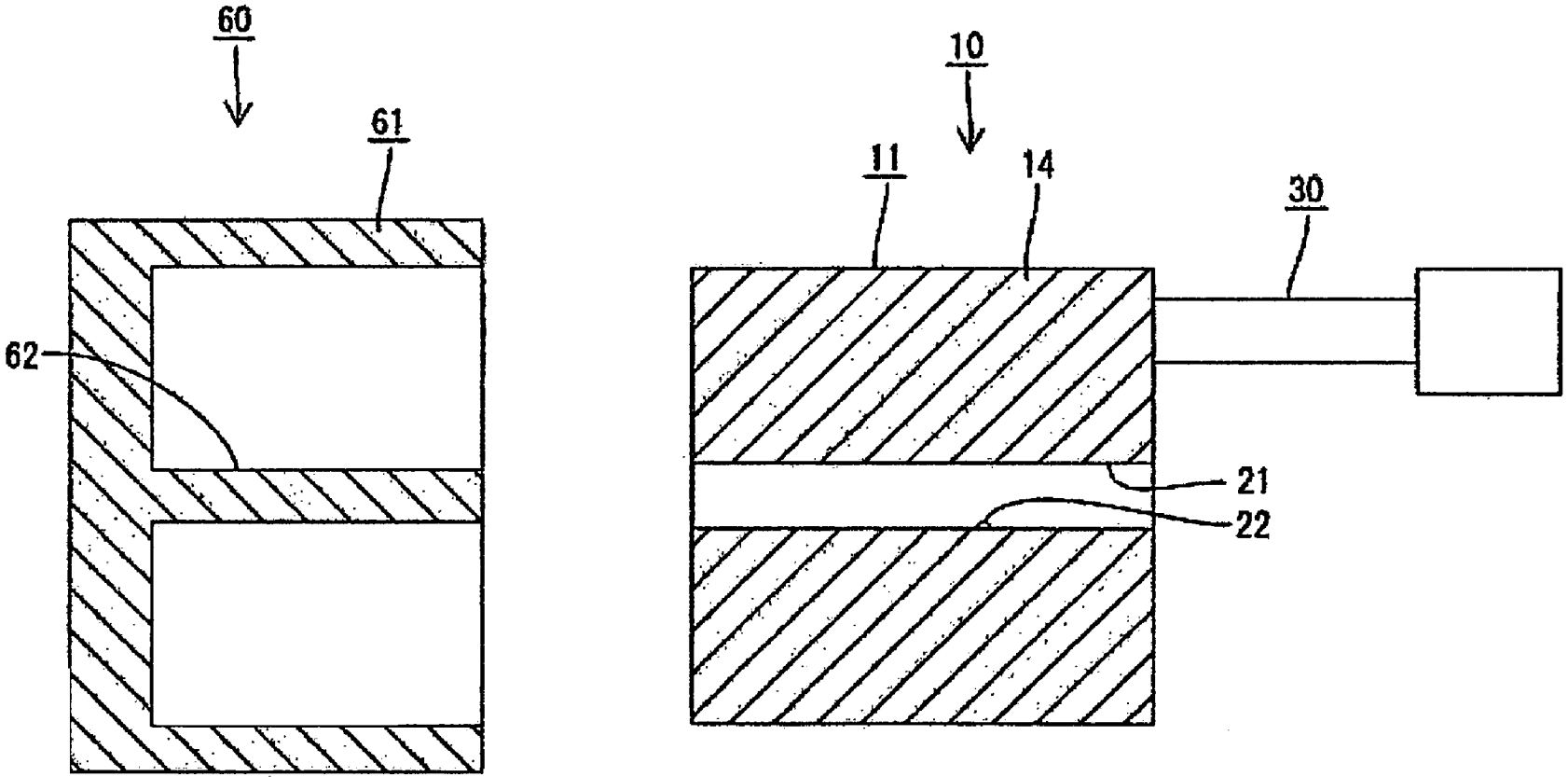
FIG. 8 is a diagrammatic section showing the state before the two housings are connected.
Figure 9:
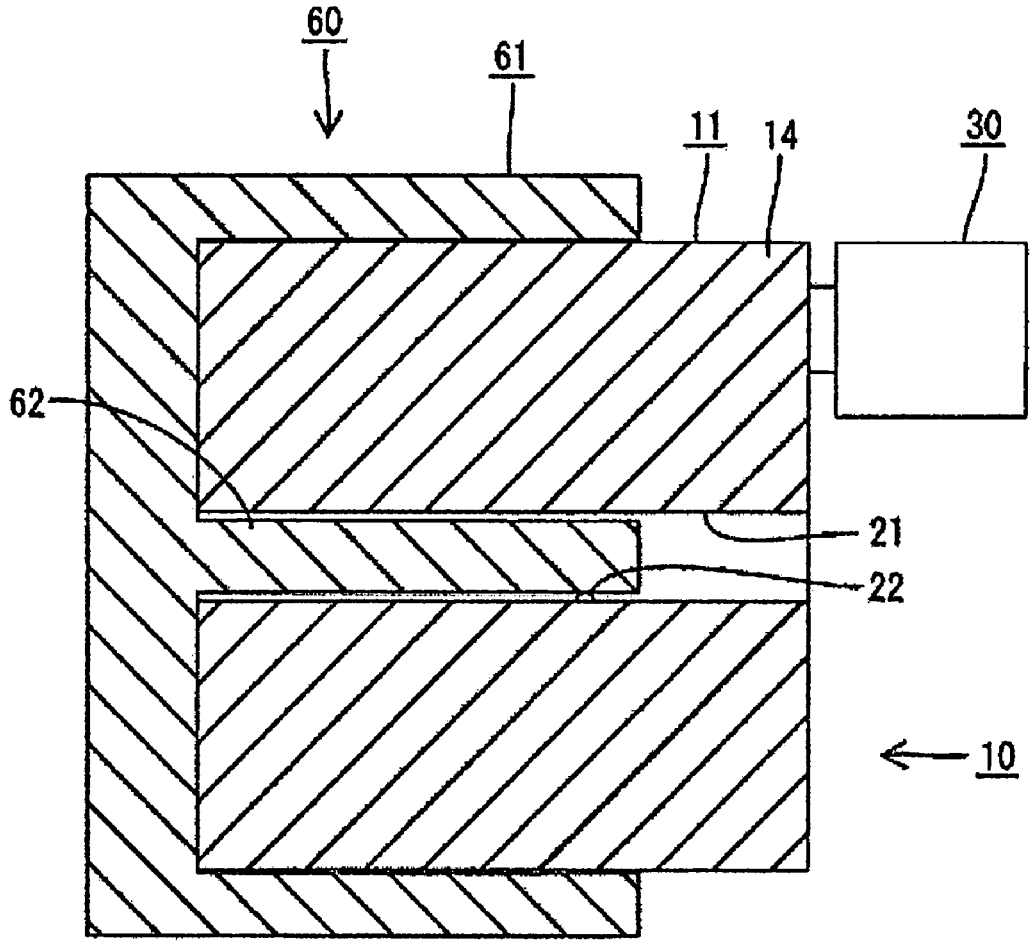
FIG. 9 is a diagrammatic section showing the state when the connecting operation of the two housings is completed.

Left and right guiding grooves 21 extend in forward and backward directions FBD in the outer surfaces of the opposite side walls 14 of the holder 11, as shown in FIGS. 7 to 9. Left and right guiding ribs 62 extend in forward and backward directions FBD on the opposite inner side surfaces of a receptacle 61 of the mating male connector housing 60 and can be received in the guiding grooves 21. Clearances are defined between the surfaces of the guiding grooves 21 and the guiding ribs 62 due to a dimensional tolerance or the like. The guiding ribs 62 might be inclined with respect to forward and backward directions FBD within the ranges of the clearances when the connecting operation of the housings 10, 60 progresses due to rotation of the lever 30. More particularly, the lever 30 is accommodated in the lever accommodating portion 16 at the top side of the holder 11 and the lever 30 is rotated in an operation direction OD towards one widthwise side of the holder 11. Therefore, an operating force acts in the operating direction OD of the lever 30 and the holder 11 is likely to be inclined.

However, a semispherical shake preventing boss 22 is provided at each guiding groove 21, and the inclination of the guide ribs 62 is suppressed by the contact of the boss 22 with the guiding ribs 62 to fill the clearances between the surfaces of the guiding grooves 21 and the guiding ribs 62. More specifically, each boss 22 is provided on one of the opposite sides of the corresponding guiding groove 21 at a side opposite to the area where the lever 30 is arranged and at the rear end of a connection area of the holder 11 facing the inner surface of the receptacle 61 when the two housings 10, 60 are connected properly. Thus, the inclination of the guiding ribs 62 and the female housing 10 can be suppressed effectively at least at a final stage of the connecting operation where the connection resistance of the two housings 10, 60 is largest.

A cam-pin entrance groove 23 is formed substantially in the widthwise center of the upper wall 12 and the ceiling wall 15 of the holder 11 and extends in substantially forward and backward from directions FBD from the front of the holder 11. A rib entrance groove 24 also is formed in the upper wall 12 of the holder 11 at a position closer to one lateral side than the cam-pin entrance groove 23 and extends in substantially forward and backward directions FBD from the front of the holder 11. A temporary holder 25 projects from a lower area at the rear end of the rib entrance groove 24 for keeping the lever 30 in the temporary held state.

A substantially cylindrical support shaft 26 projects into the lever accommodating portion 16 from a position on the upper surface of the ceiling wall 15 of the holder 11 substantially in the widthwise center and behind the cam-pin entrance groove 23. The supporting shaft 26 serves as a central axis of rotation of the lever 30. Thus, the lever 30 is rotatable about the supporting shaft 26 in a substantially horizontal plane that contains the widthwise direction WD and the forward and backward directions FBD. An engaging portion 27 is provided at an end of the upper surface of the ceiling wall 15 of the holder 11 at a side of the cam-pin entrance groove 23 substantially opposite the rib entrance groove 24 for fully locking the lever 30.

The lever 30 is made e.g. of synthetic resin and includes a narrow flat cam plate 31. The lower surface of the cam plate 31 is recessed at a position near one end to form a bearing hole 32 that is engageable with the supporting shaft 26. The cam plate 31 can be accommodated into the lever accommodating portion 16 so that the opposite plate surfaces are held substantially in contact with the lower surface of the upper wall 12 and the upper surface of the ceiling wall 15. A cam groove 33 extends from an opening at the outer peripheral edge of the cam plate 31 and continues around the bearing hole 32 along a specified path. The entrance of the cam groove 33 communicates with the entrance of the cam-pin entrance groove 23 when the lever 30 is at an operation starting position OSP.

A temporary holding piece 34 is cantilevered along an outer peripheral edge of the cam plate 31 near the bearing hole 32 and is resiliently deformable in and out. A temporary holding projection 35 is formed at the leading end of the temporary holding piece 34. The temporarily holding projection 35 is in the rib entrance groove 24 and engages the temporary holding portion 25 when the lever 30 is at the operation starting position OSP to prevent rotation of the lever 30 towards an operation ending position OEP. An operable portion 36 and a resilient locking piece 37 are at an end of the lever 30 substantially opposite the bearing hole 32 of the cam plate 31 and distanced from the bearing hole 32 and the cam groove 33. The operable portion 36 is configured to be gripped for operating the lever 30. The resilient locking piece 37 engages the engaging portion 27 for locking the lever 30 at the operation ending position OEP.

The male housing 60 is made e.g. of synthetic resin and includes a rectangular tubular receptacle 61 that is open at the front. Male terminal fittings (not shown) are mounted in the back wall of the receptacle 61 and project forward into the receptacle 61. The female housing 10 (holder 11) can be fit closely into the receptacle 61 from the front and along the forward and backward directions FBD. The male and female terminal fittings are connected electrically when the two housings 10, 60 are connected properly.

A rib 64 is formed on the ceiling surface of the receptacle 61 and extends in forward and backward directions FBD at a position displaced towards one side from a widthwise middle of the receptacle 61. The rib 64 is disposed for insertion into the rib entrance groove 24 and frees the lever 30 from a temporary held state. A substantially cylindrical cam pin 63 projects down and in at a substantially widthwise middle of the ceiling surface of the receptacle 61. The cam pin 63 of the mating male housing 60 is dimensioned to be inserted into the cam groove 33. A substantially circular jaw 65 bulges radially out at the leading end of the cam pin 63 and extends over substantially the entire circumference. The jaw 65 has a bearing surface 65A that faces towards the ceiling surface of the receptacle 61. A shaft 66 extends from the bearing surface 65A to the ceiling surface of the receptacle 61.

Figure 4:
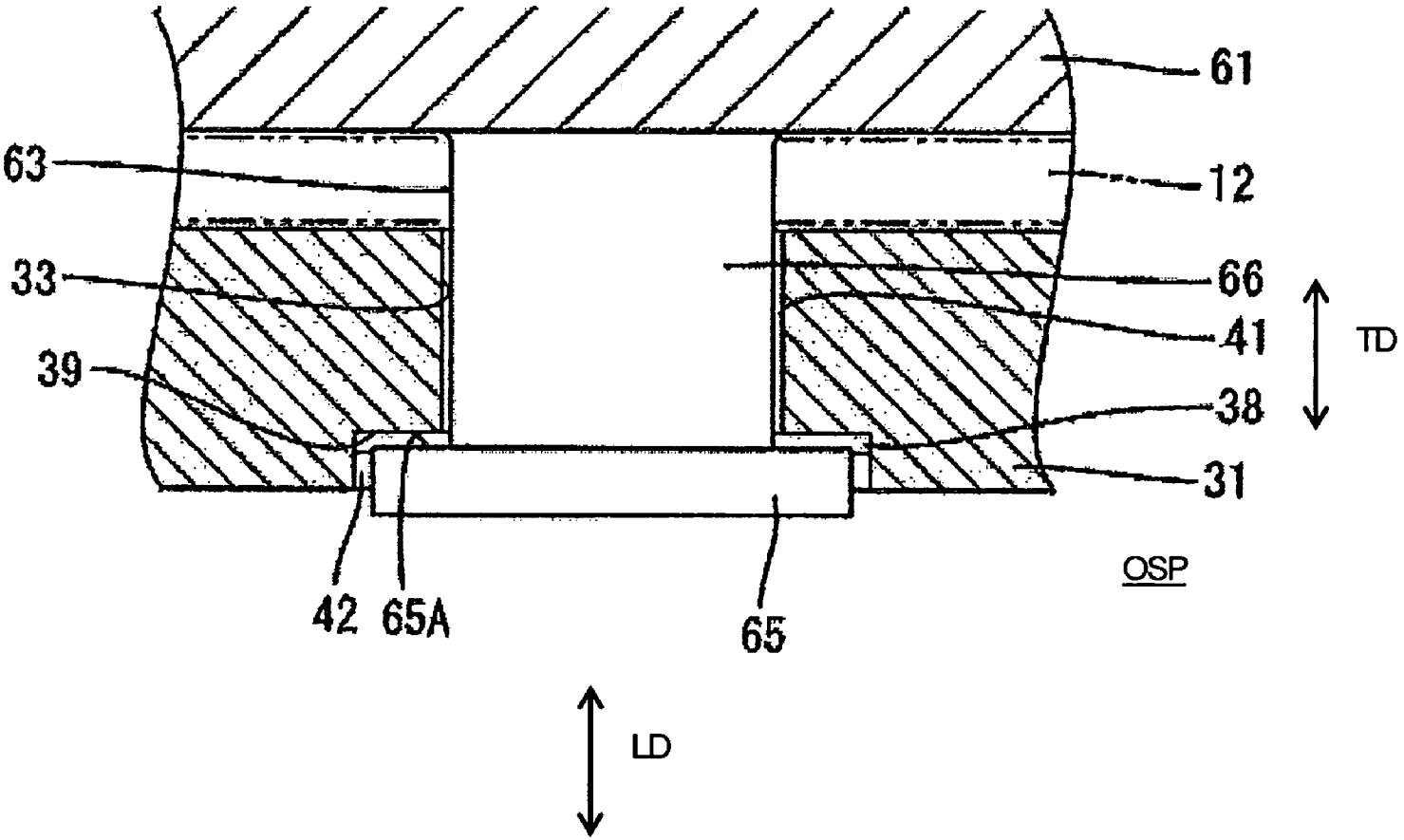
FIG. 4 is an enlarged vertical section of an essential portion showing an engaged state of a cam pin and a cam groove at the initial stage of the connecting operation of the two housings.

As shown in FIG. 4, the cam groove 33 penetrates the cam plate 31 in thickness direction TD, and includes stepped surfaces 38, 39 that face the bearing surface 65A of the jaw 65. The stepped surfaces 38, 39 are at an intermediate position of the cam groove 33 with respect to the thickness direction TD. Thus, the cam groove 33 has a narrow shaft accommodating portion 41 above the stepped surfaces 38, 39 for accommodating the shaft 66 of the cam pin 66 and a wide jaw accommodating portion 42 below the stepped surfaces 38, 39 for accommodating the jaw 65. Radial clearances are formed between the shaft accommodating portion 41 and the shaft 66 of the cam pin 63 and between the jaw accommodating portion 42 and the outer circumferential surface of the jaw 65.

The stepped surfaces 38, 39 of the cam groove 33 include inclined surfaces 38 that are inclined to gradually decrease the height of the jaw accommodating portion 42 along the thickness direction TD from the open entrance towards the closed back of the cam groove 33. The stepped surfaces 38, 39 also include a horizontal section 39 that is substantially continuous and flush with the back end of the inclined surfaces 38. Thus, the height of the jaw accommodating portion 42 along the thickness direction TD remains substantially constant along the horizontal surface 39. The horizontal surface 39 is curved substantially in a U-shape to define the closed end of the cam groove 33.

The jaw 65 is accommodated loosely in the accommodating portion 42 with clearances between the inclined surfaces 38 and the bearing surface 65A of the jaw 65 when the cam pin 63 is at the entrance of the cam groove 33. The clearances between the bearing surface 65A of the jaw 65 and the inclined surfaces 38 become gradually smaller as the cam pin 63 moves towards the back end of the cam groove 33 due to rotation of the lever 30. Loose movements of the jaw 65 are prevented when the cam pin 63 is in the portion of the cam groove 33 having the horizontal surface 39. Boundaries 47 between the horizontal surface 39 and the inclined surfaces 38 are at positions along the cam groove 33 to ensure the transfer of the jaw 65 to the horizontal surface 39 before the connection resistance of the two housings 10, 60 reaches a maximum value. Thus, the boundaries 47 are at a substantially middle position along the length of the cam groove 33 from the open end to the back end of the cam groove 33. As a result, the shaft 66 of the cam pin 63 is not likely to incline as the lever 30 is rotated in the range of peak connection resistance.

Figure 2:
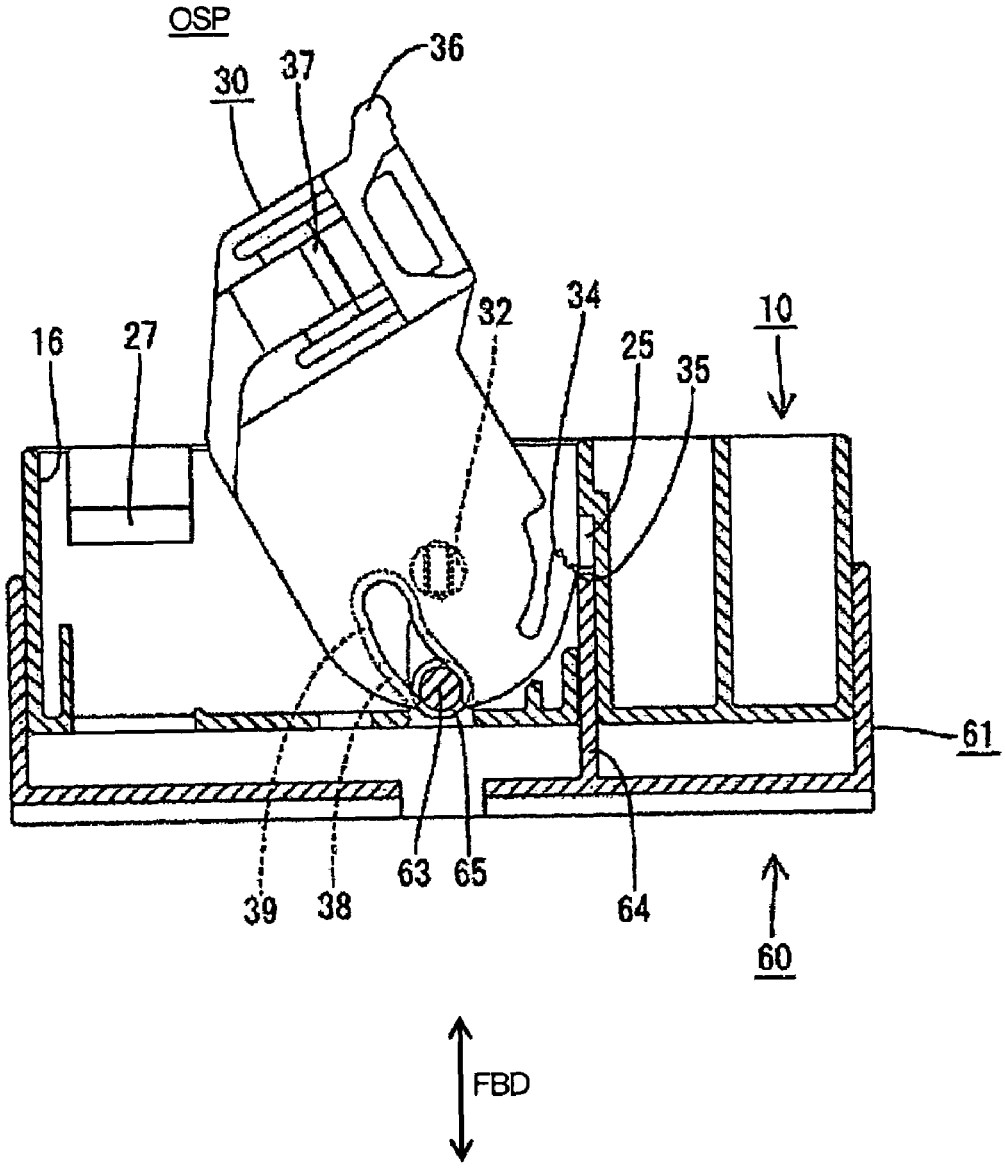
FIG. 2 is a horizontal section showing a state at an initial stage of a connecting operation of the two housings.
Figure 3:
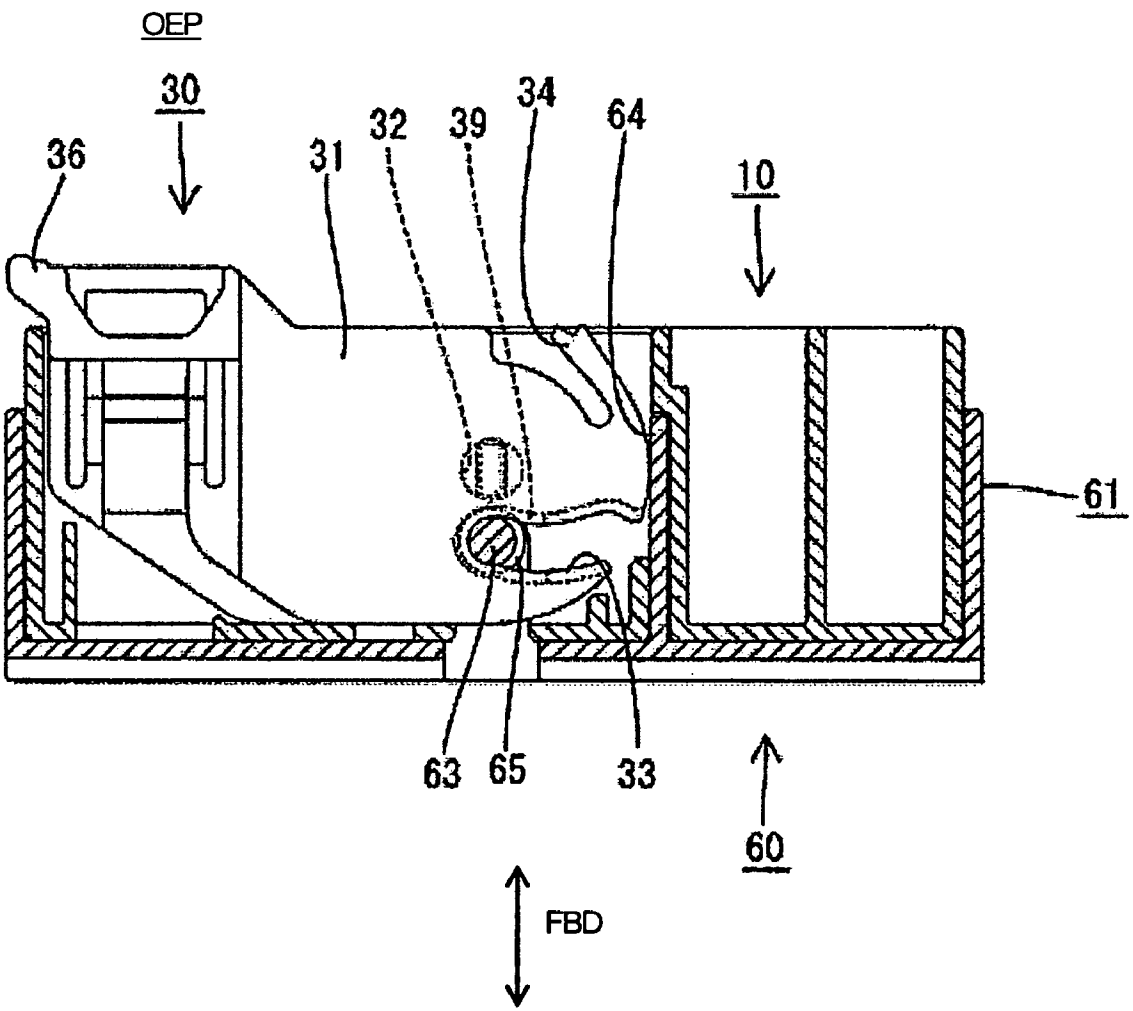
FIG. 3 is a horizontal section showing a state when the connecting operation of the two housings is completed.
Figure 6:
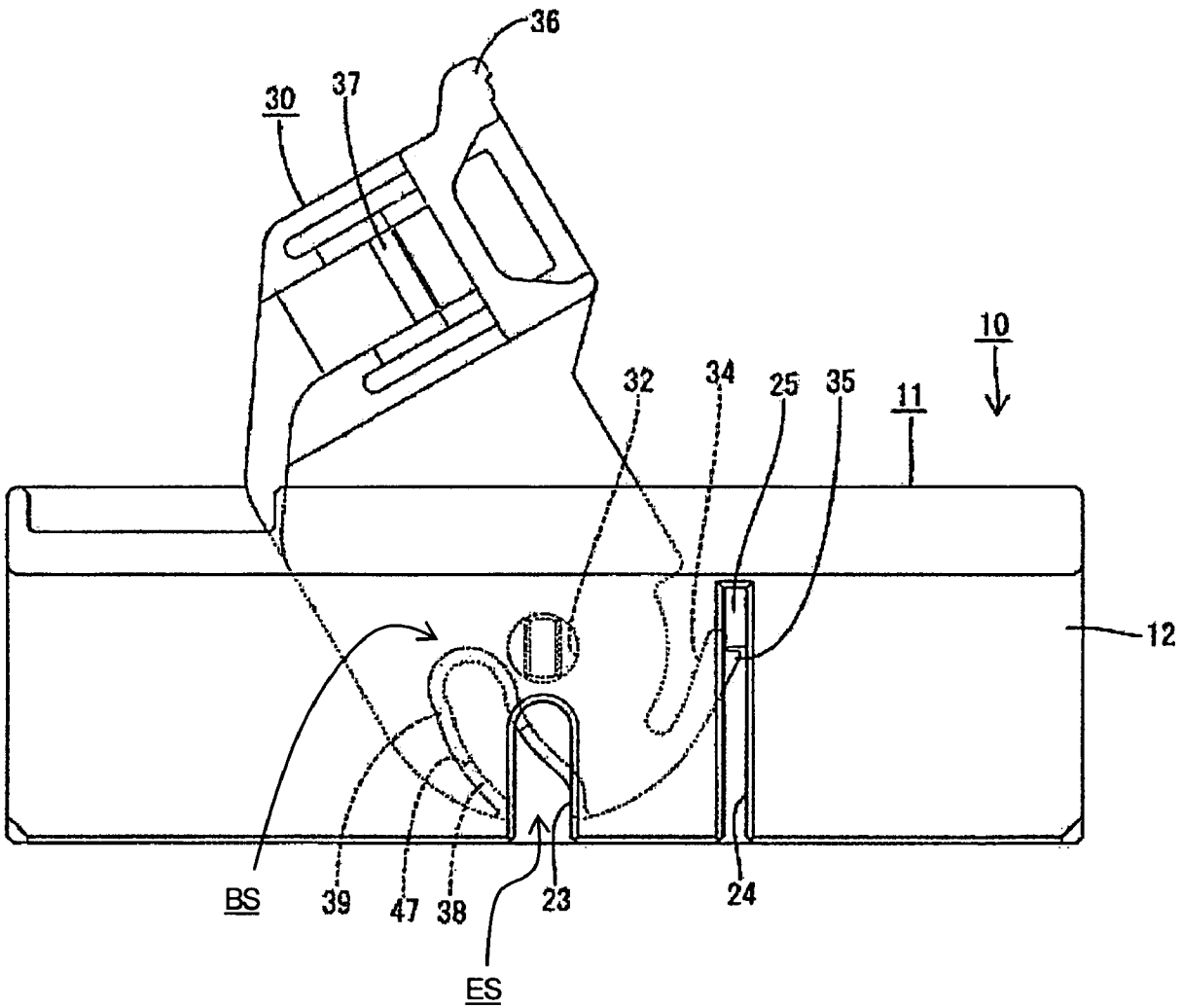
FIG. 6 is a plan view of the female housing in which a lever is held at a rotation starting position.

As shown in FIGS. 1 and 6, the lever 30 initially is held temporarily at the operation starting position OSP in the female housing 10 and the holder 11 is fit lightly into the receptacle 61 of the male housing 60 in this state. The rib 64 of the receptacle 61 then contacts the temporary holding projection 35 of the temporary holding piece 34, as shown in FIG. 2, to deform the temporary holding piece 34 in a direction to be disengaged from the temporary holding portion 25, thereby permitting rotation of the lever 30. Further, the cam pin 63 is fit into the entrance of the cam groove 33, and the jaw 65 easily is accommodated loosely into the jaw accommodating portion 42 of the cam groove 33, as shown in FIG. 4.

Figure 5:
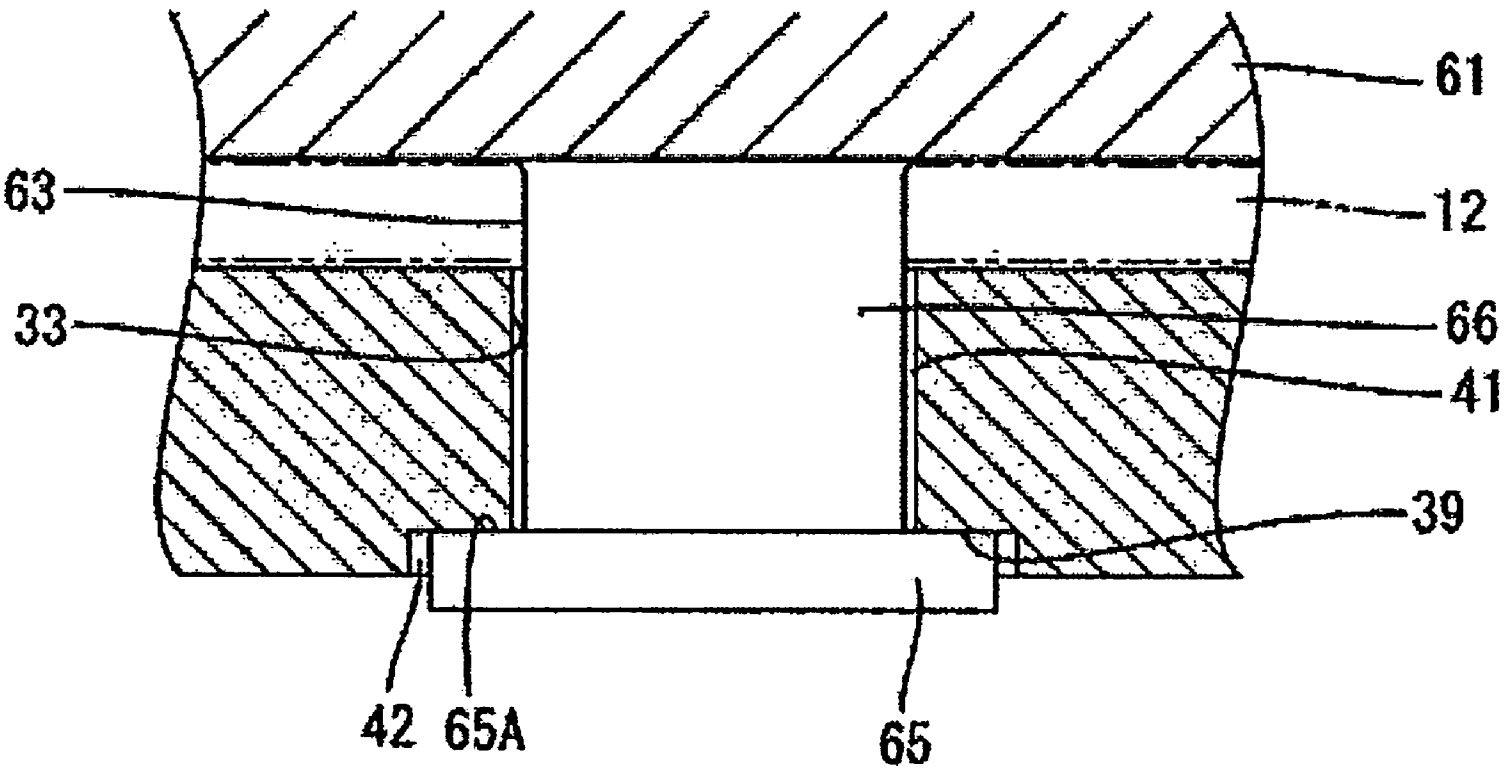
FIG. 5 is an enlarged vertical section of an essential portion showing an engaged state of the cam pin and the cam groove at a final stage of the connecting operation of the two housings.

In this state, the operable portion 36 of the lever 30 is gripped to rotate the lever 30 in the operation direction OD towards the operation ending position OED. Thus, the two housings 10, 60 are pulled together by the cam action of the cam pin 63 and the cam groove 33, and the female housing 10 (holder 11) enters more deeply into the receptacle 61. Substantially no frictional resistance results from the sliding contact of the bearing surface 65A of the jaw 65 and the inclined surfaces 38 of the cam groove 33 at the start of the rotation of the lever 30, and lever operating forces are low. Vertical displacements of the cam plate 31 and the holder 11 caused by the connecting force are avoided by the sliding contact of the bearing surface 65A of the jaw 65 and the stepped surfaces 38, 39 of the cam groove 33. The clearances between the jaw 65 and the inclined surfaces 38 of the cam groove 33 gradually narrow as the lever 30 moves towards the operation ending position OEP. Therefore the shaft 66 of the cam pin 63 is held substantially vertically in its proper posture even if subjected to the connection resistance of the two housings 10, 60. The jaw 65 moves from the inclined surfaces 38 to the horizontal surface 39 when the connection of the male and female terminal fittings is started, and the bearing surface 65A closely contacts the horizontal surface 39 with substantially no clearance, as shown in FIG. 5, before the connection resistance of the two housings 10, 60 reaches the maximum value.

The resilient locking piece 37 engages the engaging portion 27 and the lever 30 is locked when the lever 30 reaches the operation ending position OEP so that further rotation is prevented. At this time, the cam pin 63 is at the back end of the cam groove 33, the bearing surface 65A of the jaw 65 is in contact with the horizontal surface 39, and the two housings 10, 60 are connected properly.

As described above, the cam pin 63 can fit easily into the cam groove 33 and the operation force is low at the start of the rotation of the lever 30 since the depth of the stepped surfaces 38, 39 of the cam groove 33 is larger 42 at the open entrance end of the cam groove 33 so that the jaw 65 can be accommodated loosely in the jaw accommodating portion 42. On the other hand, the depth of the stepped surfaces 38, 39 of the cam groove 33 is smaller at the closed back end of the cam groove 33 so that the jaw 65 is accommodated in the jaw accommodating portion 42 while having loose movements prevented. Thus, the inclination of the shaft 66 of the cam pin 63 from a rotational axis is prevented even if the connection resistance of the two housings 10, 60 increases after rotating the lever 30 progresses to a certain degree. As a result, the lever 30 can be held in a proper rotating posture, i.e. horizontal. Further, the stepped surfaces 38, 39 of the cam groove 33 include the inclined surfaces 38 whose depth gradually decreases from the entrance side ES toward the back side BS of the cam groove 33. Hence, the clearance between the stepped surfaces 38, 39 and the jaw 65 gradually narrows as the lever 30 is rotated and the lever 30 can be rotated continuously and smoothly.

The horizontal surface 39 of the cam groove 33 is substantially continuous with the inclined surfaces 38 without forming a step, and the jaw 65 moves from the inclined surfaces 38 to the horizontal surface 39 before the connection resistance of the two housings 10, 60 reaches a maximum value. Thus, when the shaft 66 of the cam pin 63 enters a state where the shaft 66 could be urged from the vertical axis, the jaw 65 has already moved to the area where the stepped surfaces 38, 39 are shallower along the thickness direction TD, and inclination of the cam pin 63 is suppressed more effectively.

The connector is particularly useful for suppressing inclination of the cam pin 63 even if the lever 30 is a single plate and the operable portion 36 is at an end spaced from the axis of rotation and from the cam groove 33.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The stepped surface of the cam groove may consist only of the inclined section over substantially the entire length from the open end to the closed end of the cam groove.

A small clearance may be formed between the jaw and the horizontal surface of the cam groove.

The cam groove of the lever may be a bottomed groove.

The lever may be U-shaped by coupling two cam plates by a coupling portion and may be mounted to at least partly straddle the housing.

The female housing includes the holder for accommodating auxiliary housings in the foregoing embodiment. However, the female housing may be a substantially block-shaped housing formed with cavities.

The male housing may be provided with the guiding groove and the female housing may be provided with the guiding rib.

The invention is also applicable in the case where the lever is mounted in the male housing.

The invention is also applicable to connectors where the operable member displaying a cam action for connecting the housings is not a rotatable lever. For example, the operable member may be a slider with a linear operation path aligned at an angle, such as a right angle, to the forward and backward directions FBD.

What is claimed is:

1. A connector, comprising:

a housing connectable with a mating housing; and a movable member movably mounted to the housing and having at least one cam groove engageable with at least one cam pin projecting on the mating housing, a step formed at least at an intermediate position of the cam groove with respect to a depth direction and being engageable with a jaw of the cam pin, a depth of the step of the cam groove being larger at an entrance side of the cam groove so that the jaw can be accommodated loosely into an accommodating portion of the cam groove, the depth being smaller at a back side of the cam groove so that loose movements of the jaw are restricted.

2. The connector of claim 1, wherein the depth of the step gradually decreases from the entrance side toward the back side of the cam groove.

3. The connector of claim 1, wherein the accommodating portion for the jaw is defined in a wider part of the inner space of the cam groove starting from the step.

4. The connector of claim 1, wherein the cam pin is engageable in an entrance of the cam groove by lightly fitting the housing to the mating housing, the cam pin being moved towards the back side of the cam groove by operating the movable member for more deeply connecting the two housings by a cam action of the cam pin and the cam groove to reach a properly connected state.

5. The connector of claim 1, wherein the jaw is prevented from coming out of the cam groove by sliding on the step while being accommodated in the accommodating portion during connection of the two housings.

6. The connector of claim 1, wherein the step of the cam groove includes at least one inclined section whose depth gradually decreases from the entrance side toward the back side of the cam groove and a horizontal section substantially continuous with the back end of the inclined section and having a substantially uniform depth.

7. The connector of claim 6, wherein the jaw can move from the inclined section to the horizontal section before connection resistance of the two housings resulting from operation of the operable member reaches a maximum value.

8. The connector of claim 1, wherein the operable member is substantially a single plate.

9. The connector of claim 1, wherein the operable member comprises a rotatable plate and an operable portion distanced from an axis of rotation of the plate and the cam groove.

10. A connector assembly comprising the connector of claim 1 and a mating connector connectable therewith.

11. A connector, comprising:

a housing with opposite front and rear ends; and a movable member having a plate movably mounted to the housing, the plate having opposite first and second surfaces spaced from one another along a thickness direction of the plate, a cam groove formed through the plate in the thickness direction and having an open end and a closed end, a step formed in the cam groove so that the cam groove has a narrow portion adjacent the first surface of the plate and a wide portion adjacent the second surface of the plate, the wide portion having a depth measured in the thickness direction from the second surface of the plate that varies from a large depth adjacent the open end of the cam groove to a small depth adjacent the closed end of the cam groove.

12. The connector of claim 11, wherein the depth of the wide portion of the cam groove gradually decreases from the open end towards the closed end of the cam groove.

13. The connector of claim 12, wherein the wide portion of the cam groove has a section of uniform depth adjacent the closed end of the cam groove.

14. The connector of claim 11, wherein the movable member is a lever rotatably mounted on the housing.

15. A connector, comprising:

a first housing with opposite front and rear ends;

a second housing having opposite front and rear ends and at least one surface extending between the ends, a cam pin having a shaft projecting from the surface of the second housing and having a width measured parallel to the surface of the second housing, a jaw projecting out from the shaft at a location spaced from the surface of the second housing, the jaw having a width measured parallel to the surface of the second housing that exceeds the width of the shaft, the front end of the second housing being connectable to the front end of the first housing; and a movable member having a plate movably mounted to the first housing, the plate having opposite first and second surfaces spaced from one another along a thickness direction of the plate, a cam groove formed through the plate in the thickness direction and having an entry side and a back side, a step formed in the cam groove so that the cam groove has a narrow portion adjacent the first surface of the plate and dimensioned for slidably receiving the shaft, the cam groove further having a wide portion adjacent the second surface of the plate and dimensioned for receiving the jaw, the wide portion having a depth measured in the thickness direction from the second surface of the plate that varies from a large depth adjacent the entry side of the cam groove to a small depth adjacent the back side of the cam groove.

16. The connector of claim 15, wherein the jaw has a thickness measured substantially normal to a projecting direction of the shaft that substantially equals the small depth adjacent the back end of the cam groove.

* * * * *